United States Patent [19]

Bauer et al.

[11] Patent Number: 4,700,610

[45] Date of Patent: Oct. 20, 1987

[54] CYLINDER TUBE STRAIN MEASUREMENT FEEDBACK FOR PISTON POSITION CONTROL

[75] Inventors: Friedrich Bauer; Herbert Kühnelt, both of Vienna, Austria

[73] Assignee: Hoerbiger Ventilwerke Aktiengesellschaft, Vienna, Austria

[21] Appl. No.: 776,587

[22] Filed: Sep. 16, 1985

[30] Foreign Application Priority Data

Sep. 17, 1984 [AT] Austria ..... 2943/84

[51] Int. Cl.[4] ..... F15B 13/16

[52] U.S. Cl. ..... 91/390; 91/1; 91/420; 91/433; 73/9

[58] Field of Search ..... 91/1, 361, 363 R, 364, 91/275, 459, 370, 390, 471, 420, 433; 92/5 R; 73/9; 60/327; 318/645, 646, 433

[56] References Cited

U.S. PATENT DOCUMENTS

| | | | |
|---|---|---|---|
| 3,336,555 | 8/1967 | Pastan | 92/5 R |
| 3,410,177 | 11/1968 | Roess et al. | 91/361 |
| 3,726,191 | 4/1973 | Johnson et al. | 91/363 R X |
| 3,895,560 | 7/1975 | Anderson | 91/1 |
| 3,901,273 | 8/1975 | Brouwer et al. | 91/1 X |
| 4,029,122 | 6/1977 | Jaegtnes | 73/9 X |
| 4,058,178 | 11/1977 | Shinohara et al. | 92/5 R X |
| 4,086,456 | 4/1978 | Bone | 92/5 R X |
| 4,386,552 | 6/1983 | Foxwell | 91/1 |
| 4,487,044 | 12/1984 | Fapiano | 72/8 |
| 4,537,547 | 8/1985 | Cole | 91/361 X |

FOREIGN PATENT DOCUMENTS

| | | | |
|---|---|---|---|
| 2324648 | 12/1974 | Fed. Rep. of Germany | 73/9 |
| 56-22921 | 3/1981 | Japan | 73/9 |
| 58-170901 | 10/1983 | Japan | 91/361 |
| 673822 | 7/1979 | U.S.S.R. | 91/361 |
| 985736 | 12/1982 | U.S.S.R. | 73/9 |
| 1032233 | 7/1983 | U.S.S.R. | 91/361 |

OTHER PUBLICATIONS

R. Jackman et al, "The Position-Controlled Hydraulic Mill," *Journal of the Iron and Steel Inst.,* vol. 210, Apr. 1972, pp. 235–245.

Milligan, R. V., "On the Use of Foil Strain Gayes to Measure Internal Strains of Thick-Walled Cylinders." *ISA Transactions,* 15:1, pp. 95–99 (1976).

Tolliver, B. R., "Strain-Gage Pressure Transducers, New Look for an Old Standby." *Machine Design,* 49: pp. 123–127, Nov. 10, 1977.

*Primary Examiner*—Robert E. Garrett
*Assistant Examiner*—George Kapsalas
*Attorney, Agent, or Firm*—Watson, Cole, Grindle & Watson

[57] ABSTRACT

A fluid cylinder control method for monitoring the position or controlling the movements of a piston which is slidably guided in a cylinder tube and is acted upon on at least one side by a pressure medium, in particular, maintaining the piston in a predetermined position against the action of eventual disturbance forces. This is attained in that the force which is transmitted between the piston and the cylinder by way of the parts which are slidingly guided on each other, and in particular the friction force acting by way of the seal gaskets of the piston and/or of the rod, is measured and the loading of the piston by a pressure medium is varied in the sense of reducing the measured force.

3 Claims, 3 Drawing Figures

CYLINDER TUBE STRAIN MEASUREMENT FEEDBACK FOR PISTON POSITION CONTROL

BACKGROUND OF THE INVENTION

1. Field of the Invention

The present invention relates to a fluid cylinder control method for monitoring the position or controlling the movements of a piston which is slidingly guided in a cylinder tube and which is acted upon on at least one side by a pressure medium, the piston being moved into a predetermined position and maintained therein.

2. The Prior Art

In the known methods for controlling and positioning fluid cylinders, displacement sensors are used for determining the instantaneous position and the movements of the piston, their signals being evaluated in a controller. As soon as the piston leaves its predetermined position, the pressure of the pressure medium acting upon the piston is varied in such a manner that the piston is again returned to the set position. The displacement sensors indicate the instantaneous position of the piston in the cylinder with great accuracy, and also react without substantial delay. Nevertheless, oscillation and overshooting occur in these known control systems. In particular, it is practically impossible to reliably maintain the piston of a pneumatic positioning cylinder in its position when the force acting on the piston rod varies or when an unintentional variation in the pressure of the pressure medium occurs, e.g., due to leakage.

To remedy this it is already known to combine pneumatic positioning cylinders with hydraulic cylinders for controlling the position. By this means, the required equipment expenditure is considerably increased, and mostly doubled. In addition, for maintaining the piston in a given position, mechanical braking devices are known which lock the piston in the cylinder tube or lock the piston rod. These supplementary devices are also disadvantageous, as they increase equipment cost, require additional space, require additional operation, and can give rise to operational disturbances.

SUMMARY OF THE INVENTION

The object of the present invention is to improve the previously known control methods such that exact control of the movements of a fluid cylinder piston and reliable maintenance of the chosen set position are possible in a simple manner without supplementary mechanical devices.

The control method according to the invention is characterised in that in order to maintain the piston in the position into which it has been moved, the force which is transmitted between the piston and the cylinder by way of the parts which are slidingly guided on each other, and in particular the friction force acting by way of the seal gaskets of the piston and/or of the piston rod, is measured and the loading of the piston by pressure medium is varied in the sense of reducing the measured force. By this means, the disturbance forces acting on the piston are determined before they cause the piston to undergo movement. This makes it possible to promptly counteract the disturbance forces by control means. For example, if the load transmitted to the piston through the piston rod varies or if the pressure of the pressure medium acting on the piston changes, e.g., because of an untight valve or because of leakages, the control system can take corrective measures before the piston leaves the set position. It is not important to the control accuracy of the inventive method whether the absolute friction force between the seal gaskets of the piston and/or the piston rod and the cylinder is large or small because the invention measures the force exerted by the piston and/or the piston rod prior to movement with respect to the cylinder. Consequently, the use of the method according to the invention prevents the piston from undergoing unintended or uncontrolled movement as a result of any disturbance to the force equilibrium or a pneumatic or hydraulic cylinder.

In a preferred embodiment of the control method according to the invention, the force transmitted between the piston and cylinder is measured by determining the resultant thrust exerted on the piston by the pressure medium, and comparing this with the loading force transmitted through the piston rod or the support force acting on the cylinder. By this means, all disturbance forces which could cause the piston to shift from its set position are taken into account, so that any unintended displacement of the piston is reliabily prevented by prompt corrective action of the control system.

The resultant thrust exerted by the pressure medium on the piston can be easily determined by measuring the pressure of the pressure medium acting on both sides of the piston in the cylinder compartments and calculating the resultant thrust taking into account the different piston areas on which the pressure acts. It would also be possible to incorporate pressure or force sensors in the piston for determining the thrust.

The loading force transmitted through the piston rod or the cylinder support force is advantageously measured with the aid of a force sensor which is incorporated into the piston rod or into the cylinder support.

In a further embodiment of the control method according to the invention, the force transmitted between the piston and the cylinder is measured by measuring the instantaneous forces acting in the cylinder tube in the region of the two cylinder ends, and calculating the difference between the forces measured in the region of the two ends. In this respect, experience shows that besides the eventual pressure medium reaction forces which act on the cylinder tube by way of the covers which close the cylinder at its ends, only the forces transmitted by the piston and an eventual brake in the axial direction are introduced into the tube. The total forces transmitted in an axial direction between the piston and cylinder tube can therefore be determined by calculating the difference between the forces measured in the two ends of the cylinder tube.

A simple method for determining the forces acting in the cylinder tube is to fit force sensors, e.g., strain gauges, to the cylinder tube and use these to measure the instantaneous forces acting in the region of the two ends of the cylinder tube. However, according to the method of the invention, the forces acting in the cylinder tube can also be measured with the aid of pressure sensors, e.g., pressure cells, piezoelectric or magnetoelectric sensors, provided between the cylinder tube and the cylinder covers at each end of the cylinder. For example, the cylinder tube can be supported by way of three or four sensors at each end.

DESCRIPTION OF THE DRAWINGS

Embodiments of the control method according to the invention are shown in greater detail on the drawings.

DETAILED DESCRIPTION OF THE PREFERRED EMBODIMENTS

Figure 1:
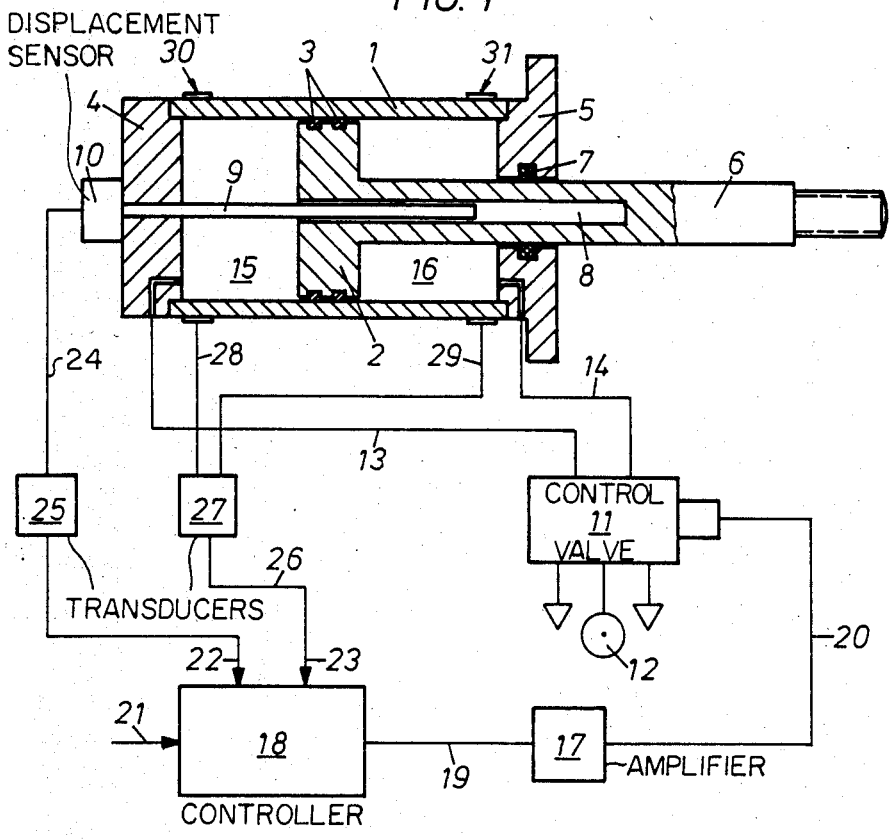
FIG. 1 is a diagrammatic illustration of the circuit diagram of a position control system for a fluid cylinder using the method according to the invention.

FIG. 1 shows a fluid cylinder consisting of a cylinder tube 1, in which a piston 2 with a piston seal gasket 3 is slidingly guided. The cylinder tube 1 is closed at both ends by covers 4 and 5. A piston rod 6 connected to the piston 2 passes through the cover 5, and is sealed by a rod gasket 7 housed in the cover 5. Starting from the piston 2, the piston 6 is of partly hollow construction. A probing rod 9 of a displacement sensor 10 disposed on the cover 4 projects into the hollow ocompartment 8. For operating the piston 2, a control valve 11 is provided which alternately connects a pressure source 12 to the cylinder compartments 15 and 16 of the two sides of the piston 2 by fluid lines 13 and 14.

The control valve 11 is controlled by a controller 18 by way of an amplifier 17. The amplifier 17 is connected to the controller 18 by a line 19 and to the control valve 11 by a line 20. The controller 18 comprises an input 21 for receiving a set value and two further inputs 22 and 23 for receiving the measured values. The input 22 is connected to the displacement sensor 10 by a signal line 24 into which a transducer 25 is connected, and a signal line 26 is connected to the input 23 from a further transducer 27. The transducer 27 is connected by two lines 28 and 29 to one of the two sets of force sensors 30 and 31, disposed in the region of one and the other end of the fluid cylinder respectively.

From the drawing it can be seen that except for the reaction forces of the covers 4, 5, the only forces introduced into the cylinder 1 in the axial direction are those which are transmitted by the piston 2 by way of the piston seal gasket 3 due to friction, or by way of an eventually provided brake device. The force sensors 30, 31 measure those forces which act collectively in the cylinder tube 1 in the region of the two ends of the fluid cylinder. The difference between the two measured forces is then calculated, the reaction forces of the two covers 4, 5 cancelling each other, the result being the force which is transmitted between the piston 2 and cylinder tube 1.

Figure 2:
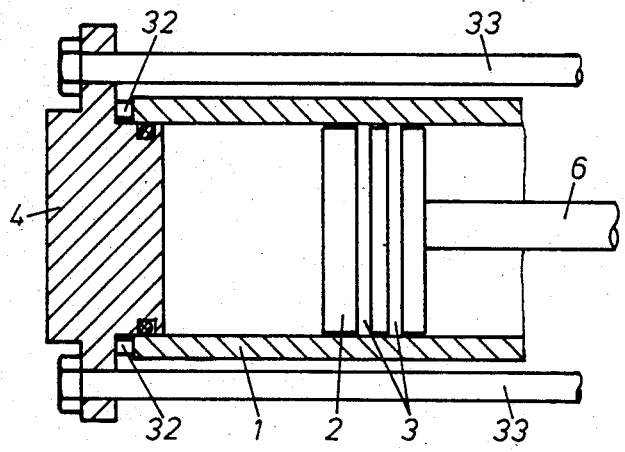
FIG. 2 is a fluid cylinder with a different force measurement system, shown partly in axial section through its centre.

In the embodiment shown in FIG. 1, the force sensors are in the form of strain gauges disposed on the outside of the ends of the cylinder tube 1. FIG. 2 shows a further embodiment in which pressure sensors 32 are used. In this case, the cylinder tube 1 is clamped between the covers 4 with the aid of tie rods 33 acting on them. The pressure sensors 32, e.g., pressure cells, piezoelectric or magnetoelectric sensors, are disposed at each end of the fluid cylinder between the cylinder tube 1 and cylinder cover 4, it being desirable to provide three or four sensors at each end. Again in this arrangement, the force transmitted between the piston 2 and cylinder tube 1 is determined by calculating the difference between the thrusts measured at the two ends of the cylinder tube 1.

Figure 3:
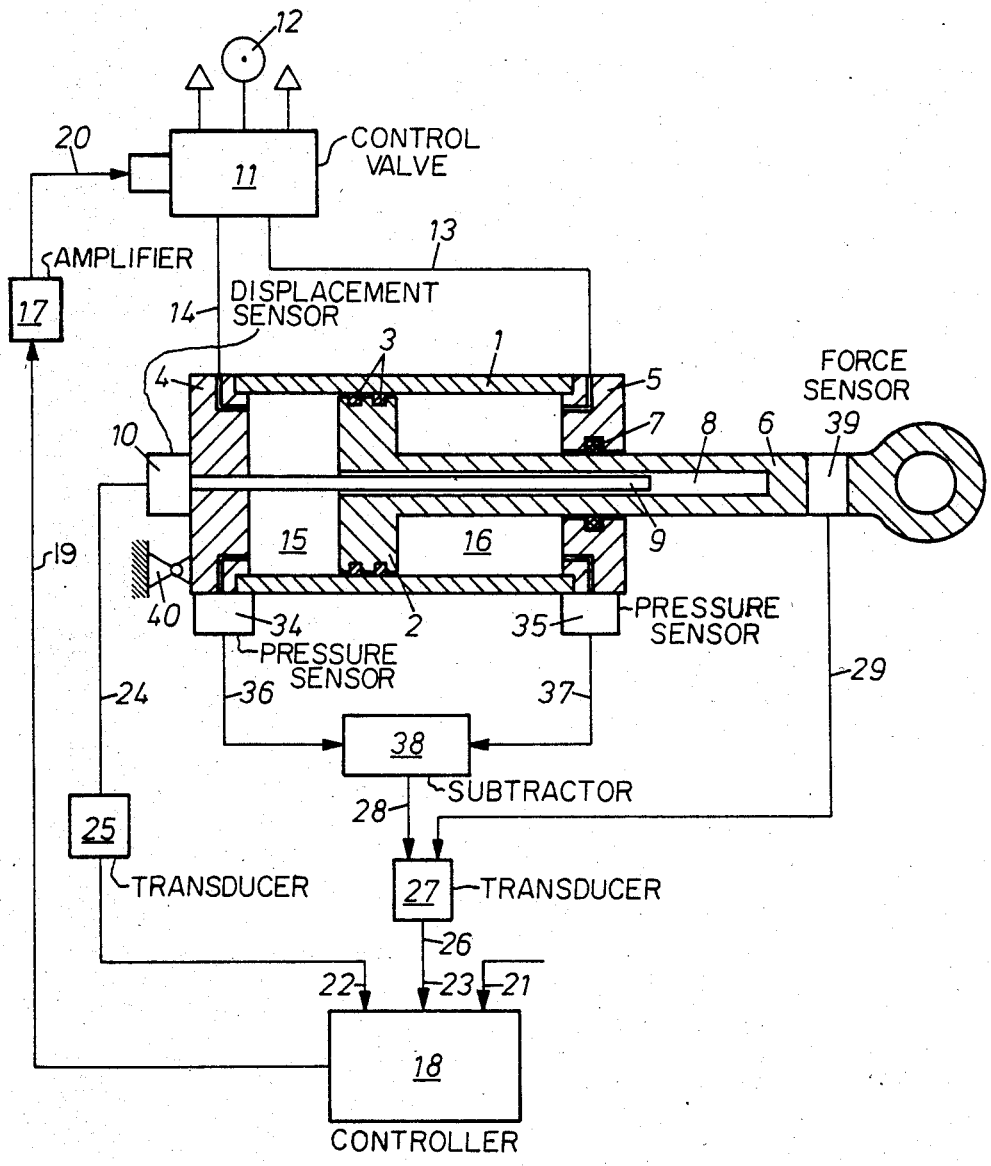
FIG. 3 is a diagrammatic illustration of the circuit diagram of a further embodiment of a control system according to the method of the invention.

The arrangement shown in FIG. 3 differs from the control system of FIG. 1 in that, in order to measure the force transmitted between the piston 2 and cylinder, a pressure sensor 34, 35 is connected to each of the two cylinder compartments 15, 16, and also connected by a line 36, 37 to a subtractor 38. The line 28 leads from this to the transducer 27, as in the embodiment of FIG. 1. In FIG. 3, the piston rod 6 is also provided with a force sensor 39 which is connected by the line 29 to the transducer 27, again as in FIG. 1. The pressure in the two cylinder compartments 15, 16 is measured with the aid of the two pressure sensors 34, 35, from which the resultant instantaneous force exerted by the pressure medium on the piston 2 can be calculated, taking into consideration the different piston areas on which the pressure acts. The force sensor 39 measures the instantaneous loading force which acts in the piston rod 6. The forces determined in this manner are compared with each other in the transducer 27, and the resultant signal is fed to the controller 18. The loading force could also be measured at the fluid cylinder support, shown diagrammatically in FIG. 3 and indicated by 40. Where applicable, the force sensor 39 would be provided at the support 40 instead of on the piston rod 6.

In monitoring the position or controlling the movements of the piston 2 with the aid of the control systems shown on the drawings, the controller 18 is fed through the input 21 with a set value, e.g., a required position of the piston in the cylinder tube 1. The instantaneous position of the piston 2 is determined with the aid of the displacement sensor 10 and its probing rod 9, and the measured signals are fed by way of the transducer 25 to the controller 18. From this, the control valve 11 is activated by way of the amplifier 17 in such a manner that the piston 2 is displaced into the position defined by the set value. The piston 2 is then required to be maintained in this position. If the set position of the piston 2 is disturbed, e.g., by the effect of external force by way of the piston rod 6 or by leakage in the pressure lines, the controller 18 must act to correct this. However, the displacement sensor 10 senses that a disturbance has arisen only after the piston 2 has changed its position.

According to the method of the invention, in order to maintain the piston 2 in the position into which it has been moved, the force which is transmitted between the piston 2 and cylinder by way of the parts which are slidingly guided on each other is continuously monitored, and the loading of the piston 2 by the pressure medium is varied in the sense of reducing the measured force. In the control system of FIG. 1, the force transmitted between the piston 2 and cylinder tube 1 by way of the piston seal gasket 3 is measured with the aid of the force sensors 30, 31 by subtraction, the signal obtained being fed to the controller 18 by way of the transducer 27. In FIG. 2, pressure sensors 32 are provided instead of the force sensors 30, 31, the force transmitted between the piston 2 and cylinder tube 1 likewise being determined by subtraction. In contrast, in the embodiment of FIG. 3 the pressure of the pressure medium in the two cylinder compartments 15, 16 is monitored and from this the force exerted on the piston 2 by the pressure medium is calculated. This force is compared with the loading force which is measured in the piston rod 6 by the force sensor. In this manner all the disturbance forces which could displace the piston are determined, account being taken not only of the friction force between the piston 2 and cylinder tube 1, but in particular also of the friction force transferred at the piston rod seal gasket 7. The signals thus obtained are computed in the transducer 27, from which the resultant signal is fed to the controller 18, which varies the loading of the piston 2 by the pressure medium in the sense of reducing the measured force.

By measuring the forces transmitted between the piston 2 and cylinder, it is possible to already send a disturbance signal to the controller 18 before the piston 2 undergoes movement caused by the disturbance. The controller 18 can then already take corrective action by way of the control valve 11 before the piston 2 leaves its set position. The controller 18 can likewise react early if for example the pressure in one of the cylinder compartments 15, 16 falls due to lack of tightness in the control valve 11 or leakage in the line system, with the result that the stable state of the piston 2 is disturbed. Variations in the loading force transmitted through the piston rod 6 are also immediately taken into account automatically, without any displacement of the piston 2 resulting. The described method can thus be advantageously used in all cases of monitoring, controlling or piloting pneumatic or hydraulic fluid cylinders.

What is claimed is:

1. In a fluid cylinder which includes a cylinder and a cooperating piston, said cylinder including cylinder tube and opposite first and second end covers, said second end cover including a bore therethrough and a rod gasket extending inwardly of said bore; said piston including a piston head which is slidingly movable within said cylinder tube and a piston rod which is connected to said piston head and extends through said bore in said second end cover so as to contact said gasket therein, said piston head including at least one piston seal gasket which contacts said cylinder tube, said piston head defining a first pressure chamber in said cylinder between said piston head and said first end cover and a second pressure chamber between said piston head and said second end cover, a method for maintaining the piston head at a predetermined position along said cylinder tube, said method comprising the steps of (1) sensing the axial force of said cylinder tube acting toward said first end cover due to the frictional force acting thereon by said piston seal gasket(s) and said rod gasket prior to movement of said piston within said cylinder tube, (2) sensing the axial force of said cylinder tube acting toward said second end cover due to the frictional force acting thereon by said piston seal gasket(s) and said rod gasket prior to movement of said piston within said cylinder tube, (3) comparing the sensed axial forces in steps (1) and (2) to determine which force is larger and thus determine in which axial direction within said cylinder said piston head is about to move, and (4) supplying pressure medium to either said first pressure chamber or said second pressure chamber to normalize said sensed forces and thereby maintain said piston head in its predetermined position along said cylinder tube.

2. The method as defined in claim 1, wherein the sensing of the axial force of said cylinder tube in step (1) is accomplished at a point around said cylinder tube adjacent said first end cover and the sensing of the axial force of said cylinder tube in step (2) is accomplished at a point around said cylinder tube adjacent said second end cover.

3. The method as defined in claim 1, wherein the sensing of the axial force of said cylinder tube in step (1) is accomplished at a point between said cylinder tube and said first end cover and the sensing of the axial force of said cylinder tube in step (2) is accomplished at a point between said cylinder tube and said second end cover.

* * * * *